United States Patent [19]

Lundeen

[11] Patent Number: 5,046,782

[45] Date of Patent: Sep. 10, 1991

[54] ROTATABLE SUN CHAIR

[76] Inventor: Jack M. Lundeen, 13608 Upton Ave. South, Burnsville, Minn. 55337

[21] Appl. No.: 529,463

[22] Filed: May 29, 1990

[51] Int. Cl.[5] ..... A47C 7/62

[52] U.S. Cl. ..... 297/349; 108/119; 248/425

[58] Field of Search ..... 297/349, 53, 54, 51; 248/188.6, 425, 430; 108/94, 127, 115, 124, 131, 118, 119, 150

[56] References Cited

U.S. PATENT DOCUMENTS

| | | | |
|---|---|---|---|
| 1,939,904 | 12/1933 | Koopman | 108/119 X |
| 2,812,012 | 11/1957 | Hansburg . | |
| 2,914,793 | 12/1959 | McMahan Sr. . | |
| 3,009,739 | 11/1961 | Hamilton | 297/349 |
| 3,096,964 | 7/1963 | Fox | 248/425 |
| 3,318,562 | 5/1967 | Hersh | 248/188.6 X |
| 3,441,310 | 4/1969 | Gale . | |
| 3,445,143 | 5/1969 | Swenson . | |
| 3,445,147 | 5/1969 | Niemi . | |
| 3,459,450 | 8/1969 | Patellaro | 297/349 X |
| 3,574,427 | 4/1971 | Faull . | |
| 4,076,346 | 2/1978 | McMahan Sr. . | |
| 4,544,202 | 10/1985 | Keaton | 297/349 |
| 4,600,239 | 7/1986 | Gerstein et al. | 297/349 |
| 4,824,170 | 4/1989 | Goldmeier | 297/349 |

FOREIGN PATENT DOCUMENTS

| | | | |
|---|---|---|---|
| 2263142 | 6/1974 | Fed. Rep. of Germany | 248/188.7 |
| 64434 | 11/1955 | France | 297/53 |

*Primary Examiner*—José V. Chen

*Attorney, Agent, or Firm*—Peterson, Wicks, Nemer & Kamrath

[57] ABSTRACT

The rotatable sun chair includes a seat, a tubular ring beneath the seat, a plurality on angularly spaced channel-shaped brackets having their web portions secured to the underside of said seat, each bracket having a pair of downwardly extending and laterally spaced side panels. A grooved roller is journaled for rotation between each of said pair of side panels, the lower end portions of the side panels being inturned beneath the tubular ring to prevent disengagement of each bracket from the ring. A pair of U-shaped leg units are pivotally connected to the underside of the ring, one of the leg units having an upwardly facing notch and the other of the leg units having a downwardly facing notch where the leg units intersect each other so that the leg units will be maintained in a supporting relationship beneath the ring and can be folded into an adjacent relation with one side of the ring when the chair is to be transported. The chair also includes a back rest and a leg rest; these components can be folded into an adjacent relation with the other side of the ring.

20 Claims, 2 Drawing Sheets

ROTATABLE SUN CHAIR

BACKGROUND OF THE INVENTION

1. Field of the Invention

This invention relates generally to chaise lounges, and pertains more particularly to a rotatable sun chair in which the user can rotate the seat (back rest and leg rest) throughout 360° so that the user can position his or her body at various angular positions, largely in accordance with the position of the sun.

2. Description of the Prior Art

Chairs with rotatable seats are not new. A myriad of office chairs utilize swivel structures so that the user can position himself or herself in various positions relative to a desk. Also, stools of various types embody a swivel-type seat. Additionally, there are children's chairs which include a seat that is rotatable with respect to a table or the like.

A rotatable lounge chair is described in U.S. Pat. No. 4,544,202, issued on Oct. 1, 1985 to Tanya L. Keaton for "SEMIAUTOMATICALLY ACTUATED ROTATABLE LOUNGE CHAIR." The patented chair utilizes a mechanism via which the user can rotate the chair through 360°. However, the chair is relatively complex, unduly heavy and vulnerable to sand when used at a beach. Also, owing to the rather complicated adjusting mechanism, the chair is relatively costly to manufacture.

SUMMARY OF THE INVENTION

Accordingly, an important object of my invention is to provide a rotatable sun chair that will be not only light in weight but also rugged and sturdy. In this regard, an aim of the invention is to provide a chair of the envisaged type in which the various components are arranged in a compressive relationship so that they can withstand a considerable amount of force, such as that resulting from the body of the person using the chair.

Another object of the invention is to provide a rotatable sun chair which is virtually frictionless and therefore capable of being rotated into various angular positions with a minimum of physical effort. Actually, it is within the purview of the invention to allow the user to rotate the seat of the chair while sitting or lying on the seat, thereby obviating any need for the user to remove his or her body from the chair when making a rotative adjustment.

Inasmuch as it is contemplated that my sun chair be used at beaches, as well as on patios and at other places, it is important to provide a chair that is not vulnerable to sand and dirt. Thus, my invention has for an additional object the provision of a rotatable sun chair that will not be vulnerable to sand that might otherwise interfere with the facile rotation of the seat.

Yet another object of the invention is to provide a chair of the foregoing character that can be readily collapsed for carrying from place to place. Not only can the chair when constructed in accordance with my invention be folded into a compact relationship for transporting it the collapsibility of my chair facilitates the shipping thereof from the factory to distribution points. In other words, my chair possesses knockdown features that render it particularly suitable for use under varying conditions.

Still further, my rotatable sun chair, even though adjustable into various angular positions, is exceedingly stable in that it will not inadvertently tilt or tip over.

Contributing to the chair's stability is the underlying leg structure and the relatively large diameter of the tubular ring thereabove.

Also, my invention does not require relatively expensive materials or close manufacturing tolerances, these advantages contributing to its relatively low fabrication costs, thereby encouraging its widespread use.

Briefly, my invention utilizes a tubular ring having foldable leg units therebeneath. Through the agency of channel-shaped brackets, each having a roller journaled for rotation therein, a seat is supported for rotation through 360°. When not in use, the leg units are easily folded into a substantial planar relationship with the ring member, and the back and leg rests can also be folded into a substantially planar relationship with the seat. It is planned that a segment of the tubular ring be used as a handle when transporting the chair from one location to another. The construction renders my rotatable sun chair especially suitable at beaches and the like.

DESCRIPTION OF THE PREFERRED EMBODIMENT

Figure 1:
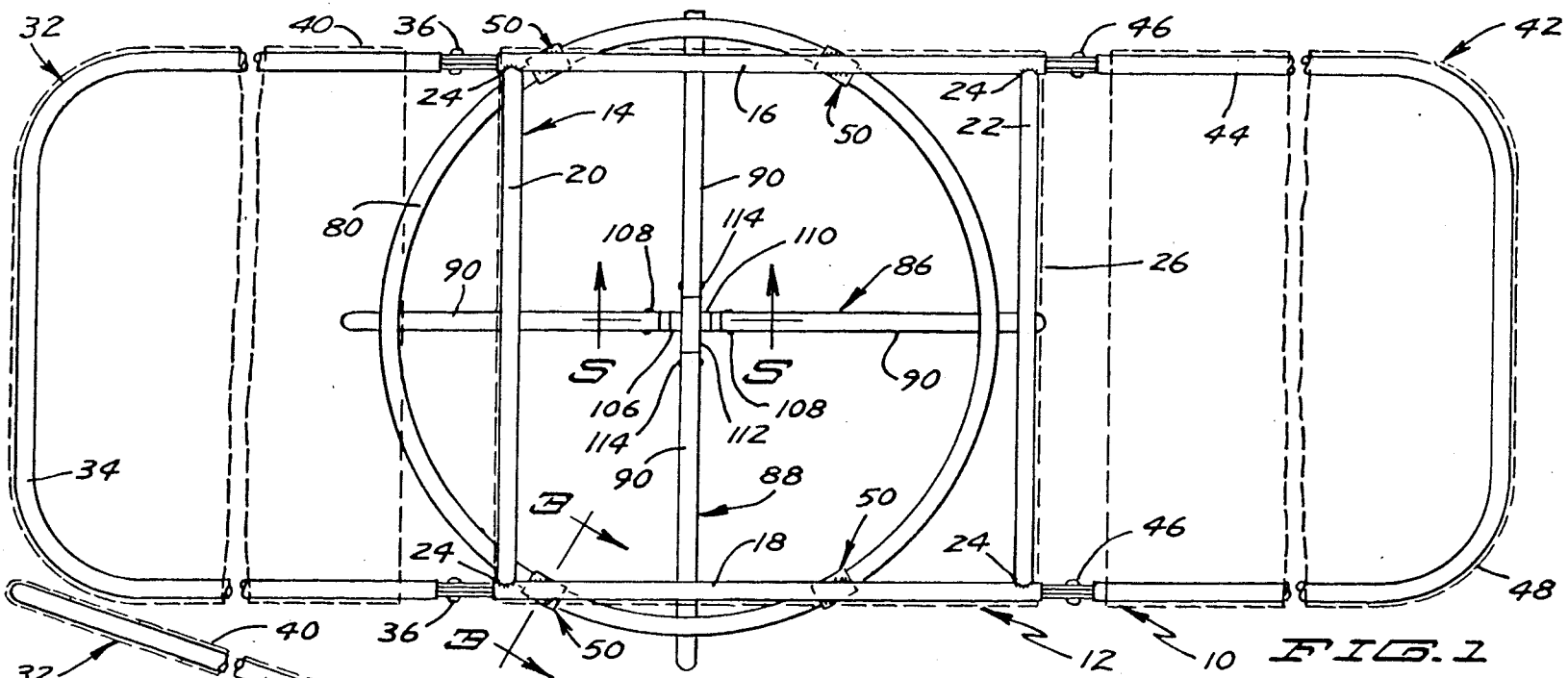
FIG. 1 is a top plan view of a rotatable sun chair exemplifying my invention, portions of the back rest and the leg rest having been removed to permit a larger drafting scale to be employed.

Referring now to the rotatable and collapsible sun chair illustrating my invention, the sun chair has been denoted generally by the reference numeral 10. The sun chair 10 comprises a seat 12 involving the use of a rectangular frame 14, such as of aluminum tubular stock, having laterally spaced side members 16, 18 and transverse members 20, 22, these members 16-22 being welded together by four welds 24 to form the rectangular frame 14. Fabric 26 has been indicated in phantom outline in FIGS. 1 and 2 for covering the rectangular frame 14 to form the completed seat 12, although a fragmentary portion of the fabric 26 appears in the upper part of FIG. 3. Any preferred number of drive screws, such as the one indicated by the reference numeral 28 in FIG. 3, maintain the fabric 26 taut with respect to the rectangular frame 14, yet allowing the fabric 26 to be changed later if circumstances so dictate.

The chair 10 includes a back rest 32 utilizing a U-shaped member 34, also of tubular stock, that is suitably pivoted at 36 to the frame 14. Various pivotal mechanisms are currently available and the specific such mechanism is not important to a practicing of my invention; in this regard, the most suitable and quite commonly used device is the so-called pivotal ratchet mechanism that enables the user to select various angular positions of the back rest 32 relative to the seat 12. The back rest 32 includes the fabric 40 that is again depicted only in phantom outline.

A leg rest 42 in the form of a U-shaped tubular member 44 is pivotally attached to the rectangular frame 14 at 46. Here again, even though only phantomly illustrated, a fabric 48 covers the U-shaped tubular member 44.

Figure 3:
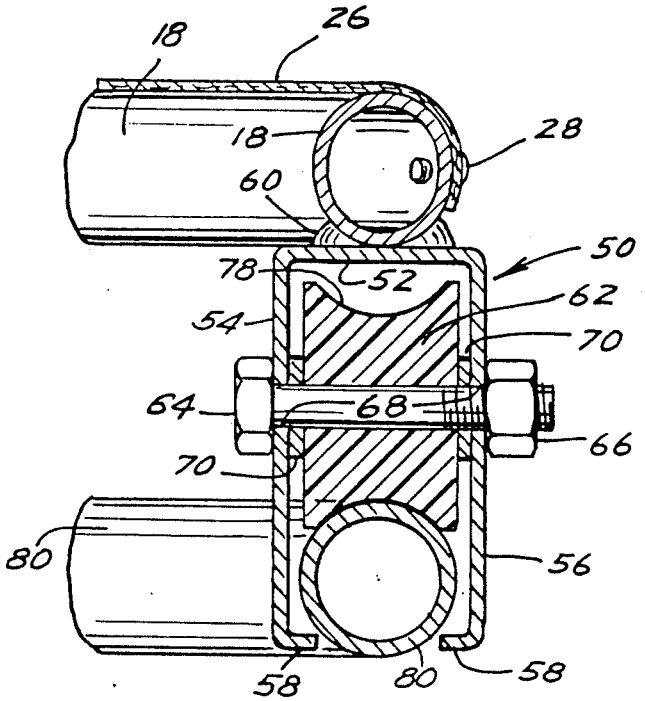
FIG. 3 is an enlarged sectional detail taken in the direction of line 3—3 of FIG. 1 for the purpose of showing the mounting of one of the four rollers enabling my sun chair to rotate through 360°.

Hence, the several fabrics 26, 40 and 48 may all be attached by means of appropriate fasteners, such as the drive screw 28 appearing in FIG. 3.

Playing an important role in the practicing of my invention are four channel-shaped brackets 50, preferably of sheet metal. Each bracket 50 includes a horizontal web or bight 52 and laterally spaced, downwardly extending side panels or flanges 54, 56. It is important to note that the lower end portions of these side panels 54, 56 are inturned, as best viewed in FIG. 3; the inturned end portions have been assigned the reference numeral 58. By means of welds 60, each web or bight 52 is permanently secured to the undersides of the side members 16 and 18.

Attention is directed at this time to a plastic roller 62, such as of high density polyethylene, that is journaled between the side panels 54, 56 of each of the channel-shaped brackets 50. More specifically, each roller 62 rotates on the shank portion of a bolt 64 that is held in place by a nut 66, the bolt 64 passing through holes 68 formed in the side panels or flanges 54, 56. Additionally, washers 70 facilitate the rotation of each roller 62. The rollers 62 each have an arcuate groove 78 extending peripherally therearound.

A tubular ring 80 has a cross section correlated with the curvature of the groove 78, as can be readily understood from FIG. 3. From FIG. 1, though, it can be seen that the ring 80 is of sufficient diameter so as to cause segmental portions thereof to project beyond the rectangular frame 14, more specifically beyond its tubular side members 16, 18.

Inasmuch as there are four angularly spaced brackets 50 secured to the underside of the rectangular frame 14, the four rollers 62, there being one such roller 62 journaled in each of the four channel-shaped brackets 50, adequately support the seat 12 for rotation through 360°. As can be readily appreciated from FIG. 3, the inturned end portions 58 have a lateral spacing less than the cross section of the ring 80 so that each bracket 50 is held captive with respect to the ring 80, yet the brackets 50 are free to be rotated to any position along the ring 80 by reason of the rollers 62.

Figure 4:
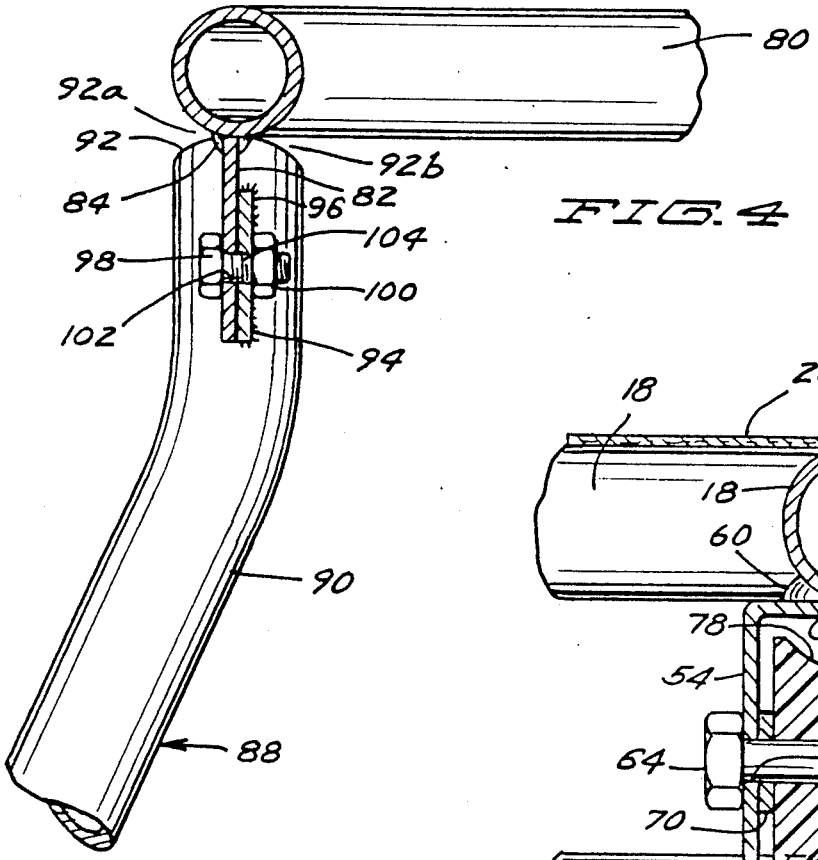
FIG. 4 is a sectional detail taken in the direction of line 4—4 of FIG. 2 for the purpose of illustrating how the two leg units can be folded, although they are shown in their chair supporting relation.

Quadrantly spaced lugs or ears 82 are welded at 84 to the underside of the ring 80, as can be seen from the one appearing in FIG. 4. Whereas only two ears 82 can be seen in FIG. 2, these being at the 6 o'clock and 9 o'clock positions as viewed in FIG. 1, it will be understood that two additional ears 82 are located at the 3 o'clock and 12 o'clock positions in FIG. 1.

Reference will now be made to two generally U-shaped leg units 86 and 88, each including a pair of L-shaped tubular segments 90 having upper ends rounded at 92 (as can be discerned from FIG. 4) and also having lugs or ears 94 welded at 96. Through the agency of a bolt 98 for each of the L-shaped segments 90, the mounting of these segments 90 render the leg units 86, 88 foldable in that the bolt 98 serves a pivot pin. Each bolt 98 has a nut 100 threaded thereon, the bolt 98 in each instance extending through a hole 102 in the lug or ear 82 and a hole 104 in the lug or ear 94, as clearly indicated in FIG. 4.

The generally U-shaped leg unit 86 has a plastic coupling 106. The coupling 106 is simply a cylindrical member having reduced diameter end portions that permit the end portions thereof to be received in the adjacent ends of the L-shaped segments 90 belonging to the leg unit 86. The plastic coupling 106 is retained in place by rivets 108. From FIG. 5, it will be seen that the coupling 106 has an upwardly facing notch 110. The other leg unit 88 has a somewhat similar plastic coupling 112 held in place by rivets 114. While the two couplings 106 and 112 are generally similar, the coupling 112 has a downwardly facing notch 116. In this way, when the leg units 86 and 88 are in an erect or supporting position, that is, in the intersecting relationship appearing in FIG. 1, then the plastic couplings 106 and 112 are engaged with each other, the notches 110 and 116 maintaining the erect condition of the leg units 86, 88, yet permitting the leg units 86, 88 to be readily folded into a confronting relationship with the ring 80, the tubular L-shaped segments 90, there being two such segments 90 for each of the leg units 86, 88, flexing sufficiently by virtue of their inherent resiliency to permit disengagement of the notches 110 and 116 and thus permit the folding of the leg units 86, 88, as well as the unfolding thereof.

Figure 2:
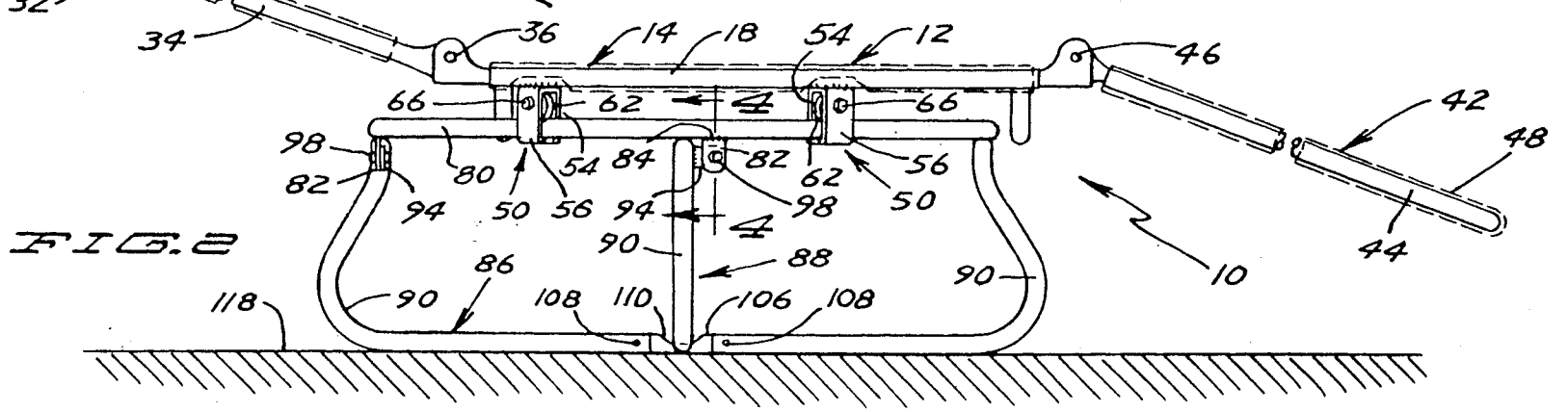
FIG. 2 is a side elevational view corresponding to FIG. 1.
Figure 5:
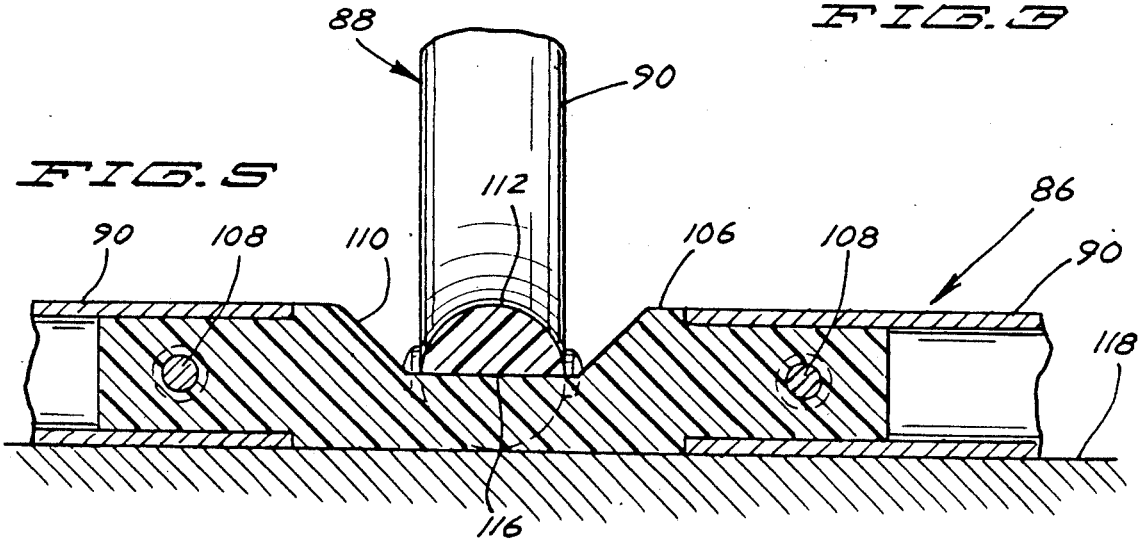
FIG. 5 is a sectional detail taken in the direction of line 5—5 of FIG. 1 for the purpose of depicting how the leg units are maintained in their supporting relationship.

Although my rotatable sun chair 10 can be supported on various surfaces, a surface 118 has been shown in FIGS. 2 and 5. For the sake of simplicity, the surface 118 is relatively smooth. However, it is intended that my chair 10 be used on uneven or irregular surfaces, such as that frequently encountered at beaches.

The rollers 62 are shielded from grit to some degree by the side panels 54 and 56 of the brackets 50. Even though the brackets 50 are open in fore and aft relationship, the rollers 62 are for all practical purposes are sufficiently protected from sand and other foreign matter. Sand will normally roll off the tubular ring 80, but even if particles of sand should adhere to the upper surface of the ring 80, the rollers 62 simply roll over any such grit and thus do not detract from the virtual frictionless rotation of the seat 1 (and the rests 32 and 42 hingedly attached to the frame 14 of the seat 12). All that the user need do is to use his or her hands (or feet) to rotate the seat 12 accomplishing this without getting off the chair 10.

The rotation of the seat 12 can be easily realized through 360°. To permit this to occur, the spacing between the inturned end portions 58, while sufficiently small to hold each bracket 50 captive with respect to the ring 80, nonetheless are spaced sufficiently far apart so that the four lugs or ears 82 can readily pass between each pair of inturned end portions 58. A visual comparison of FIGS. 3 and 4 should illustrate that this can occur. Also assisting in this capability is the rounded upper ends 92 on the various L-shaped segments 90 of the U-shaped leg units 86 and 88. It will be perceived that the rounded end 92 appearing in FIG. 4 provides notches **92*a* and 92*b* at each side, the inturned ends 58 passing through these notches 92*a*, 92*b* whenever the seat 12 is rotated through a sufficient angle which would otherwise provide an obstruction for the lugs or ears 82**.

Yet whenever my rotatable sun chair 10 is to be transported from one place to another, the leg units 86 and 88 can readily be folded, as well as the rests 32 and 42, so that an exceedingly compact structure results. While the collapsed condition of the chair 10 has not been pictured, it should be recognized that an arcuate segment of the ring 80, owing to the fact that it extends beyond the side members 16 and 18, enable the user to grasp such an arcuate segment for lifting and carrying the chair 10 when collapsed. Also, the collapsibility factor permits a compact packaging of the chair when being initially shipped from the factory.

I claim:

1. A rotatable sun chair comprising a ring member having an underside and an upper side, seat means having an underside, leg means attached to the underside of said ring member for supporting said ring member, a plurality of angularly spaced channel-shaped bracket members, each having web portion secured to the underside of said seat means and having a pair of laterally spaced side panels extending downwardly from said web portion, and a roller journaled between the side panels of each of said bracket members, said rollers riding on the upper side of said ring member whereby said seat means is supported for rotation on said ring member via said rollers and said bracket members.

2. A rotatable sun chair in accordance with claim 1 in which said side panels have lower ends and said rollers are journaled for rotation at an elevation above the lower ends of said side panels and the lower ends of said side panels are inturned so as to extend partially beneath said ring member to prevent disengagement of said bracket members from said ring member.

3. A rotatable sun chair in accordance with claim 2 in which said leg means includes first and second U-shaped units having upper ends, and respective means pivotally connecting the upper ends of said U-shaped units to the underside of said ring member at quadrantly spaced locations so that said U-shaped members can be pivoted between a folded position and a supporting position, with the U-shaped members being in a generally planar relation with said ring member in the folded position and in an intersecting relation with said ring member in the supporting position.

4. A rotatable sun chair in accordance with claim 3 in which said pivotally connecting means each includes a downwardly extending ear having an upper edge secured to the underside of said ring member, and a lug having an edge secured to the upper end of said U-shaped members, and a bolt extending through said ear and said lug.

5. A rotatable sun chair in accordance with claim 4 in which said U-shaped members have intersecting portions, with the intersecting portion of the first U-shaped member having an upwardly facing notch formed therein and the intersecting portion of the second U-shaped member having a downwardly facing notch formed therein, with the downwardly facing notch received in the upwardly facing notch to maintain said U-shaped members in a supporting relationship with said ring member.

6. A rotatable sun chair in accordance with claim 4 in which the downwardly extending ears have a thickness and in which said inturned lower ends are laterally spaced a distance greater than the thickness of the ears extending downwardly from said ring member and are located to allow the ears to pass between the lower ends of the side panels when the seat means is rotated on the ring member.

7. A rotatable sun chair in accordance with claim 6 in which the ring member has an arcuate cross section and each of said rollers has a peripheral groove having an arcuate cross section corresponding generally to the arcuate cross section of said ring member.

8. A rotatable sun chair in accordance with claim 1 in which said ring member has a diameter and said seat means has a width less than the diameter of said ring member.

9. A rotatable sun chair in accordance with claim 1 in which the ring member has an arcuate cross section and each of said rollers has a peripheral groove having an arcuate cross section corresponding generally to the arcuate cross section of said ring member.

10. A rotatable sun chair in accordance with claim 1 in which said leg means includes first and second U-shaped units having upper ends, and respective means pivotally connecting the upper ends of said U-shaped units to the underside of said ring member at quadrantly spaced locations so that said U-shaped members can be pivoted between a folded position and a supporting position, with the U-shaped members being in a generally planar relation with said ring member in the folded position and in an intersecting relation with said ring member in the supporting position.

11. A rotatable sun chair in accordance with claim 10 in which said pivotally connecting means each includes a downwardly extending ear having an upper edge secured to the underside of said ring member, and a lug having an edge secured to the upper end of said U-shaped members, and a bolt extending through said ear and said lug.

12. A rotatable sun chair in accordance with claim 11 in which said U-shaped members have intersecting portions, with the intersecting portion of the first U-shaped member having an upwardly facing notch formed therein and the intersecting portion of the second U-shaped member having a downwardly facing notch formed therein, with the downwardly facing notch received in the upwardly facing notch to maintain said U-shaped members in a supporting relationship with said ring member.

13. A rotatable sun chair in accordance with claim 11 in which the downwardly extending ears have a thickness and in which said inturned lower ends are laterally spaced a distance greater than the thickness of the ears extending downwardly from said ring member and are located to allow the ears to pass between the lower ends of the side panels when the seat means is rotated on the ring member.

14. A sun chair comprising, in combination: means for supporting a user of the chair, with the supporting means including seat means; first and second U-shaped leg units, with each of the leg units including first and second upper ends; means for pivotally connecting the first upper end of the first leg unit to the supporting means at a first position; means for pivotally connecting the second upper end of the first leg unit to the supporting means at a second position; means for pivotally connecting the first upper end of the second leg unit to the supporting means at a third position; means for pivotally connecting the second upper end of the second leg unit to the supporting means at a fourth position, with the pivotally connecting means allowing the U-shaped leg units to be pivoted between a folded position and an erect position, with the first, third, second, and fourth positions being at quadrantly spaced locations so that the U-shaped leg units intersect at intersecting portions in the erect position; an upwardly facing notch formed in the intersecting portion of the first leg unit; and a downwardly facing notch formed in the intersecting portion of the second leg unit, with the downwardly facing notch received in the upwardly facing notch when the first and second U-shaped leg units are in the erect position.

15. The sun chair of claim 14 wherein the U-shaped leg units comprise, in combination: first and second L-shaped segments having the upper ends and opposite ends; a coupling having a first end portion retained to the opposite end of the first L-shaped segment and a second end portion retained to the opposite end of the second L-shaped segment, with the notches formed in the couplings.

16. The sun chair of claim 15 wherein the L-shaped segments are tubular and have a diameter; wherein the coupling is cylindrical having a diameter less than the diameter of the L-shaped segments, with the end portions of the coupling being received in the opposite ends of the L-shaped segments.

17. The sun chair of claim 16 wherein the pivotally connecting means comprises, in combination: a downwardly extending ear having an upper edge secured to the supporting means; a lug having an edge secured to the upper end of said U-shaped leg units; and a bolt extending through said ear and said lug.

18. The sun chair of claim 17 wherein the supporting means further includes means for rotatably supporting the seat means.

19. The sun chair of claim 14 wherein the pivotally connecting means comprises, in combination: a downwardly extending ear having an upper edge secured to the supporting means; a lug having an edge secured to the upper end of said U-shaped leg units; and a bolt extending through said ear and said lug.

20. The sun chair of claim 14 wherein the supporting means further includes means for rotatably supporting the seat means.

* * * * *